US006877506B2

(12) United States Patent
Shekarri

(10) Patent No.: US 6,877,506 B2
(45) Date of Patent: Apr. 12, 2005

(54) ADJUSTABLE KITCHEN ISLAND CONTROL

(75) Inventor: Nache D. Shekarri, Phoenix, AZ (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/455,644

(22) Filed: Jun. 5, 2003

(65) Prior Publication Data

US 2003/0226560 A1 Dec. 11, 2003

Related U.S. Application Data

(60) Provisional application No. 60/386,876, filed on Jun. 6, 2002.

(51) Int. Cl.[7] ..... F24C 15/20

(52) U.S. Cl. ..... 126/299 R; 126/299 D; 108/50.13; 108/50.18; 108/106

(58) Field of Search ..... 126/299 R, 299 D, 126/39 BA, 21 R, 300, 214 A; 312/140.1, 209, 312, 319.5, 319.8; 108/147, 17, 20, 50.13, 50.18, 106, 96; 454/63

(56) References Cited

U.S. PATENT DOCUMENTS

| | | | | |
|---|---|---|---|---|
| 2,554,694 A | | 5/1951 | Belt | |
| 2,674,991 A | | 4/1954 | Schaefer | |
| 2,974,663 A | | 3/1961 | Humbert | |
| 3,011,492 A | | 12/1961 | Humbert | |
| 3,031,946 A | | 5/1962 | Watt et al. | |
| 3,381,679 A | | 5/1968 | Gonzalez | |
| 3,391,689 A | | 7/1968 | Roger | |
| 3,409,005 A | | 11/1968 | Field | |
| 3,628,311 A | | 12/1971 | Costarella et al. | |
| 3,802,158 A | | 4/1974 | Ohle | |
| 3,841,062 A | | 10/1974 | Molitor et al. | |
| 4,011,802 A | | 3/1977 | Molitor et al. | |
| 4,127,106 A | | 11/1978 | Jensen | |
| 4,323,373 A | | 4/1982 | Fritz | |
| 4,351,652 A | | 9/1982 | Wisting | |
| 4,352,349 A | * | 10/1982 | Yoho | 126/299 R |
| 4,407,266 A | | 10/1983 | Molitor | |
| 4,446,849 A | | 5/1984 | McFarland | |
| 4,484,563 A | | 11/1984 | Fritz et al. | |
| 4,501,260 A | | 2/1985 | Grace | |
| 4,822,385 A | | 4/1989 | Strege et al. | |
| 4,934,337 A | | 6/1990 | Falk | |
| 5,020,511 A | | 6/1991 | Liu | |
| 5,069,197 A | | 12/1991 | Wisting | |
| 5,139,009 A | * | 8/1992 | Walsh | 126/299 R |
| 5,141,538 A | | 8/1992 | Derington et al. | |
| 5,358,540 A | | 10/1994 | Tsan-Yun et al. | |
| 5,359,990 A | | 11/1994 | Hsu | |
| 5,427,570 A | | 6/1995 | Chen | |

(Continued)

FOREIGN PATENT DOCUMENTS

| | | |
|---|---|---|
| FR | NO. 557775 | 6/1957 |
| FR | 002619198 A1 | 10/1989 |
| FR | 2730040 A1 | 8/1996 |
| GB | DE 3503-236 A | 1/1985 |
| JP | 62-288436 | 12/1987 |
| JP | 403017455 A | 1/1991 |

OTHER PUBLICATIONS

"We Get to the Source of the Problem" The Difference is Gaggenau, May 2002.

*Primary Examiner*—James C. Yeung
(74) *Attorney, Agent, or Firm*—McKee, Voorhees & Sease, P.L.C.

(57) ABSTRACT

The present invention provides for an electronic control system for an adjustable kitchen island having a cooking surface and a vent hood, an island height control for controlling the height of the adjustable kitchen island and a vent hood control for controlling the position of the vent hood over the cooking surface. The vent hood is laterally adjustable between extended and retracted positions, and is height adjustable between raised and lowered positions.

24 Claims, 5 Drawing Sheets

U.S. PATENT DOCUMENTS 6,044,838 A 4/2000 Deng
6,079,407 A 6/2000 Lai
D434,486 S 11/2000 Segers
6,213,575 B1 * 4/2001 Brin et al. ..... 312/140.1
6,238,463 B1 5/2001 Helm
6,276,358 B1 8/2001 Brin, Jr. et al.
6,604,520 B2 * 8/2003 Grimm et al. ..... 126/299 D
2003/0084047 A1 * 5/2003 Williamson ..... 707/10
2003/0227240 A1 * 12/2003 Khosropour et al. ..... 312/319.5

* cited by examiner

ADJUSTABLE KITCHEN ISLAND CONTROL

CROSS-REFERENCE TO RELATED APPLICATIONS

This application claims benefit from Provisional U.S. Application Ser. No. 60/386,876 filed Jun. 6, 2002.

BACKGROUND OF THE INVENTION

The present invention relates to kitchen islands. Kitchen islands are common and popular, and often include a gas or electric stove top for cooking. Islands, as with most kitchen countertops, typically are built at a height of 30". However, this height is not comfortable for tall or short people. Therefore, there is a need for an adjustable height kitchen island to accommodate different height cooks in the kitchen.

SUMMARY OF THE INVENTION

The present invention provides for control of a kitchen island. According to one aspect, the present invention provides an electronic control system for an adjustable kitchen island having a cooking surface and a vent hood. The electronic control system includes an island height control for controlling a height of the adjustable kitchen island and a vent hood control for controlling the height of the vent hood over the cooking surface. The electronic control system is preferably such that it can simultaneously control the island height control and the vent hood control. Also, preferably the electronic control system is reprogrammable. Simultaneous control of multiple parts of the kitchen island and reprogrammability can both be provided for when electronic control system includes an FPGA. The FPGA can provide for a module associated with the island height control and a module associated with the vent hood control. The FPGA can further provide for modules associated with other inputs or outputs used in controlling the adjustable kitchen island. For example, modules can include a fan control module, a bubbler control module, a heater control module, and other modules.

According to one aspect of the present invention, an electronic control system for an adjustable kitchen island is provided. The electronic control system includes a plurality of inputs, a plurality of outputs for controlling the adjustable kitchen island, and a FPGA electrically connected to the plurality of inputs and a plurality of outputs, the FPGA has a plurality of modules associated with different subsets of the plurality of outputs so that multiple outputs are simultaneously controllable.

According to another aspect of the present invention, a kitchen island is provided. The kitchen island includes a vent hood assembly having a vent hood adapted for moving between an extended position and a retracted position, and electromechanical device operably connected to the vent hood assembly for moving the vent hood between the extended position and the retracted position, and an electronic control system electrically connected to the electromechanical device wherein the electronic control system includes a FPGA for controlling the vent hood.

DETAILED DESCRIPTION OF THE INVENTION

The present invention provides for electronic control of a kitchen island. The structure of the kitchen island of the present invention is set forth in greater detail in Applicant's co-pending applications entitled "VENT HOOD FOR A KITCHEN STOVE" Ser. No. 10/164,731, "KITCHEN AIR FILTRATION SYSTEM" Ser. No. 10/163,543 and "IMPROVED KITCHEN ISLAND VENT HOOD" Ser. No. 10/163,558, all filed on Jun. 6, 2002.

Figure 1:
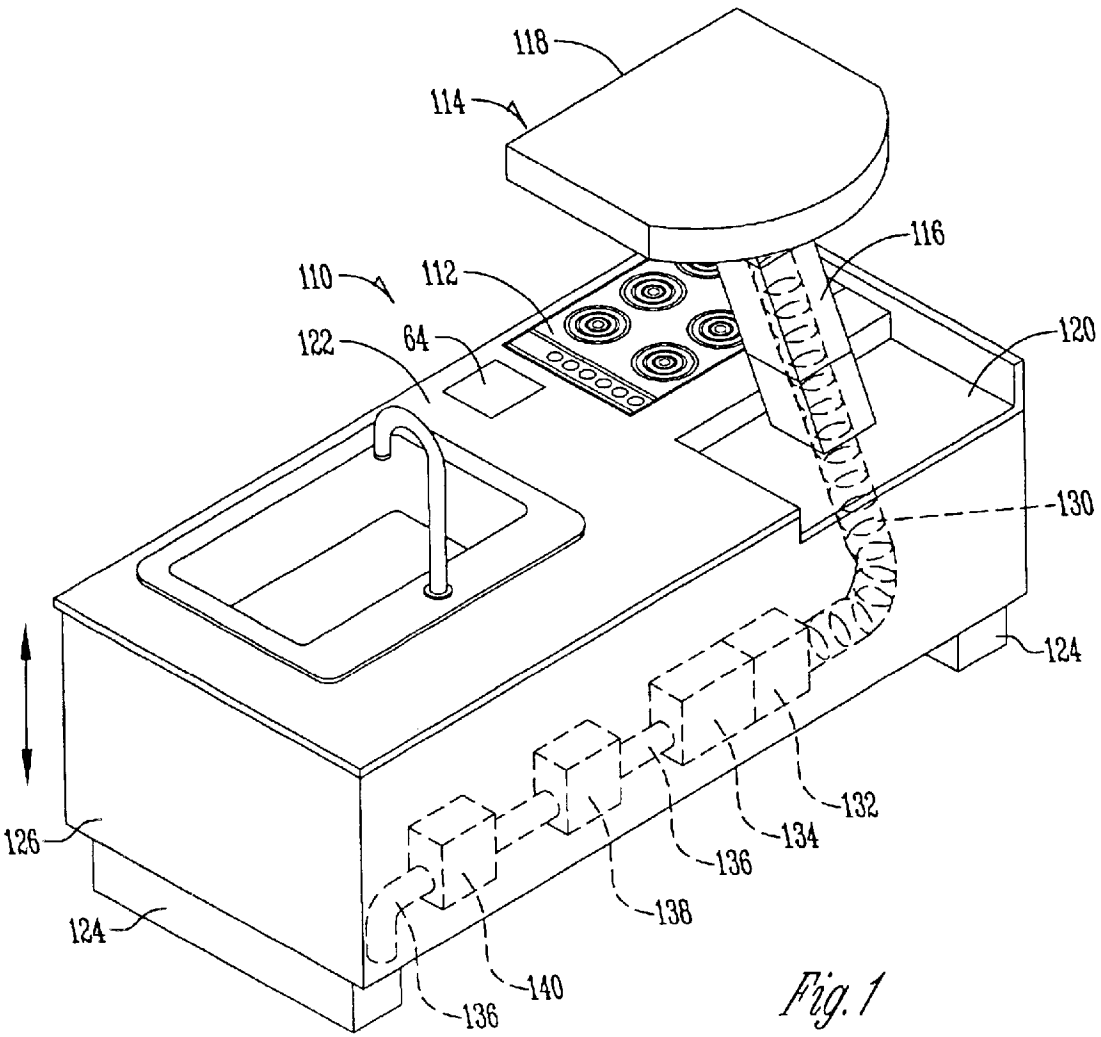
FIG. 1 is a perspective view of the adjustable kitchen island of the present invention with an adjustable vent hood.

An adjustable kitchen island is generally designated by the reference numeral 110 in the drawings. The island 110 includes a stove top or cooking surface 112 and an adjustable vent hood assembly 114. The vent hood assembly 114 includes a telescoping lift column 116 with a retractable and extendable vent hood 118 mounted on top of the column 116. As seen in FIG. 1, the assembly 114 extends upwardly in the operative or use position from a recessed area 120 in the island 110. In the non-use or storage position, the assembly 114 resides within the recess 120. Preferably, when the assembly 114 is lowered and retracted into the recess 120, the top of the vent hood 118 is slightly above the countertop 122 of the island 110 so as to discourage the setting of an object on the edge of the vent hood 118 where the object could fall off or spill when the assembly 114 is raised. Alternatively, the top of the vent hood 118 can be flush with the countertop 122 when the assembly 114 is in the storage position.

Figure 2:
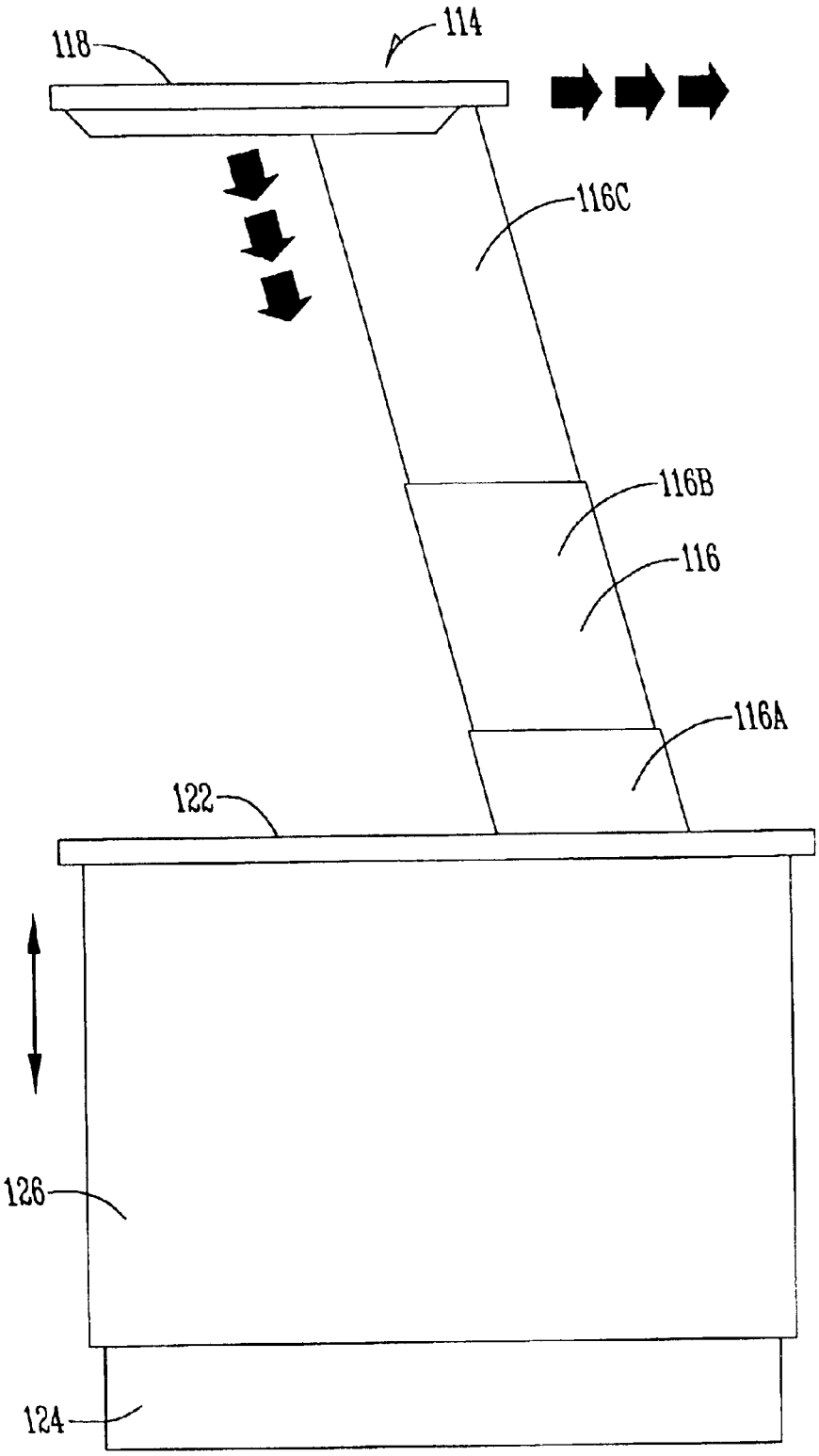
FIG. 2 is a side elevation view of the adjustable kitchen island with adjustable vent hood according to the present invention.

As seen in FIGS. 1 and 2, the column 116 preferably extends at a non-perpendicular angle relative to the cooking surface 112. The angle is in the range of 10°–20° from vertical, with the preferred angle of 15°. The telescoping sections 116A, 116B, and 116C of the column 116 are movable between raised and lowered positions, as indicated by the downwardly angled arrows in FIG. 2.

The vent hood 118 is mounted on the column 116 so as to be horizontally movable between the extended position shown in FIGS. 1 and 2, and a retracted position, as represented by the horizontal rearwardly directed arrows in FIG. 2. The angular orientation of the column 116 allows the vent hood 118 to be positioned fully over the cooking surface 112 with less forward movement as compared to a vertical column. It is understood that the column 116 may be vertically oriented, though such an orientation would require a greater extension of the vent hood 118 for positioning over the cooking surface 112.

The adjustable kitchen island 110 includes a base or legs 124 residing on the floor and a body 126 movably mounted on the base 124. The countertop 122 is mounted on the body 126. Any convenient means may be utilized to raise and lower the body 126 and countertop 122, such as hydraulics, pneumatics, or motor driven gears or threaded shafts, so as to adjust the height of the countertop 122. An electronic control system, described below, provides for control of the height of the countertop 122 of the kitchen island 110.

A flexible duct 130 extends from the vent hood 118 and downwardly through the lift column 116 into the body 126 of the kitchen island 110. The flexible duct raises and lowers with the lift column 116. The lower end of the duct 130 is connected to a bubbler filter assembly 174 to remove cooking vapors from the air. A blower 134 draws air through the duct 130 and bubbler filter 132 and discharges filtered air into the outlet duct 136. A humidifier 138 and heater 140 may optionally be provided in the outlet duct 136. The outlet duct 136 preferably discharges the filtered air for recycling back into the kitchen. Alternatively, the outlet duct 136 can be connected to an exhaust duct (not shown) in the floor to carry the vented air for discharge outside the house.

Figure 3:
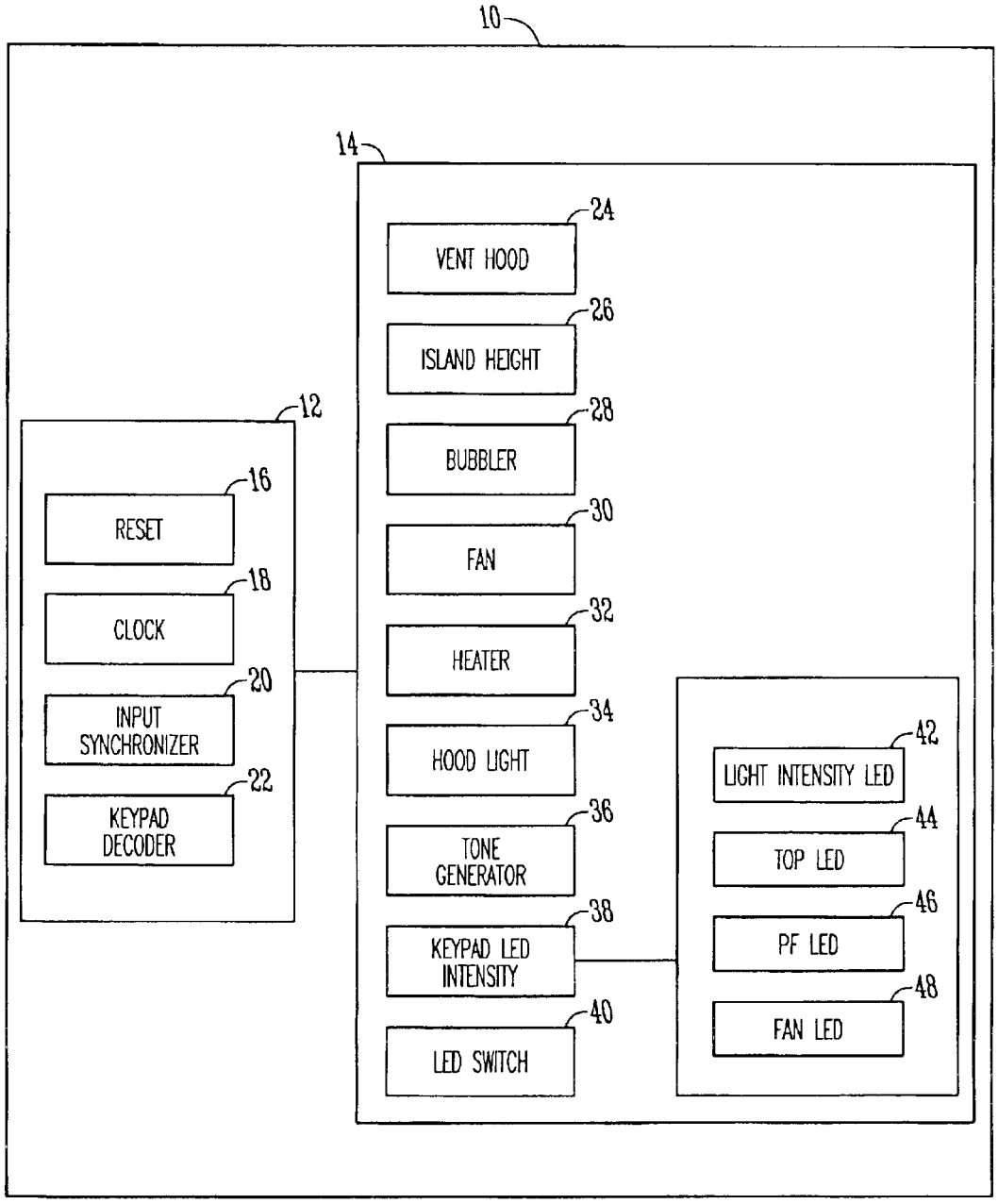
FIG. 3 is a block diagram of an FPGA used for controlling the components of the adjustable kitchen island.

In one embodiment, a Field Programmable Gate Array (FPGA) controls the user adjustable kitchen island. FIG. 3 provides a diagram of an FPGA 10 according to one embodiment of the present invention. By using a FPGA 10, all the inputs 12 and outputs 14 can be processed in parallel as opposed to a microcontroller which must execute instructions sequentially. This parallel processing is used to improve performance, response time and safety of the kitchen island. In addition, the FPGA 10 gives re-configurability to the functionality of the island. The FPGA 10 receives input from a plurality of inputs 12. The inputs 12 can include user keypad, position sensors and various conditioned analog sensors associated with the kitchen island. These inputs 12 are then used to control various features of the island through outputs 14 such as height, bubbler, lights, valves, heater, etc. The present invention contemplates that an ASIC could be used instead of an FPGA, but an FPGA is preferred. The control system provides convenient features such as automatic height adjustment, and auto lights on and off. It provides feedback to the user by means of audible beeps when a button is pressed, and by LED indicators on the key pad. The control system allows the user to manually adjust the height of the countertop via the keypad. It also permits the user to store two memory positions either of which the countertop can be automatically adjusted to by the press of a button. The operation of the control system is described in the different functional modules listed below.

The reset module 16 receives a reset pulse upon power-up of the island. It generates control system adjustable reset pulses to hold all the other modules (except the clock module 18) in reset for a fixed time. This allows the rest of the island to power up before any control inputs or outputs are executed. The reset module 16 also forces all the other modules and their outputs to known states which are maintained in until the reset has timed out.

The clock module 18 provides a clock time base for the different control state machines and speaker tones/beeps. The clock module 18 receives its input from an external oscillator and generates different divided down clock frequencies for the different modules. By adjusting the clock frequencies generated, different speaker tones are produced, and most importantly, response time can be adjusted. The clock module 18 provides the ability to balance the performance of the system with the amount of available registers used in the FPGA 10. For example if 100 nanoseconds response times are needed, it would require using larger counters in some of the modules, to maintain user friendly operations. This results in more resources being used, but improved speed of responses.

The input synchronizer module 20 synchronizes the inputs into the FPGA 10 to the internal clock, to prevent latching of the module's state machines. All the inputs from the keypad and sensors first enter this module for synchronization.

The keypad decoder 22 times how long a button on the keypad is pressed and sends appropriate signals to the module that the button pressed relates to. For every button pressed, the speaker beeps.

The vent hood module 24 provides control of the vent hood. The vent hood module 24 operates based on inputs from the decoder 22 and position sensors on the vent hood. The vent hood module 24 enables the user to automatically raise or lower the hood by single button presses, or manually by pressing and holding the required control button. It also incorporates safety by disabling operation of the bubbler, lights and heater, when the hood's height is below 12 inches. In addition, below the 12 inch height this module prevents the user from moving the vent hood forward, as this could cause damage to the user or the vent hood. Another safety feature designed is an instant motion stop when the hood is moving automatically in one direction and the opposite direction button is pressed.

The island height module 26 executes out the height adjustment for the island 110. It enables the user to manually adjust the countertop height, or it can adjust the island.

The bubbler module 28 controls the valves of the bubbler filter 132 when enabled by the vent hood module 24. It receives inputs from the decoder 22, and from float sensor 72 and temperature sensors 66, 68, 70. Below a hood height of 12 inches, the normal operation of this module 28 is disabled.

The fan module 30 controls the speed of the fan or blower 134 of the bubbler filter 132. It has five different levels that the user can set the speed to, and corresponding LEDs on the keypad 64 are lit for each level. For convenience, there is a single press full on/off feature that allows the user to press the fan up/down button for more than 0.5 seconds to turn the fan full speed on/off. Similar to the bubbler module 28, the fan module 30 is enabled only above a hood height of 12 inches. Below that height, it is disabled to prevent damage.

The heater module 32 controls the heater 140. When there is a difference in temperature between the room and the output air from the bubbler 132, the heater module 32 turns on the heater 140. Below a hood height of 12 inches, the normal operation of the heater module 32 is disabled. The heater 140 will also preferably only be operated when the bubbler fan 134 is on. If the heater 140 is on and the bubbler fan 134 is turned off, the heater 140 will be turned off and the fan 134 will be kept on for a specific amount of time before it is then turned off.

The hood light module 34 is used to control the intensity of the vent hood lights (not shown), which are on the lower surface of the hood 114 to illuminate the stove top 112. The hood light module 34 has five different levels that the user can set the light to, and for convenience, a single press full on/off feature that allows the user to turn the lights fully on or off by pressing the corresponding light up/down button for more than 0.5 seconds. Visual LED level indicators on the keypad are lit for each intensity level of the light. The hood light module 34 also permits the vent hood 114 to brighten or dim the lights as it rises or lowers automatically. Similar to the heater module 32, the hood light module 34 is enabled only above a hood height of 12 inches.

The tone generator module 36 is used to generate audible tones or beeps for button presses or vent hood warnings in conjunction with logic block 37.

The keypad LED intensity module 38 is used to control the intensity of the keypad LEDs by adjusting the pulse duty cycle of the LEDs. Modules associated with various LEDs are also connected to the LED intensity module 38. Light intensity LED module 42, countertop LED module 44, PF LED module 46, fan LED module 48 provide for LEDs whose intensity is determined based upon the LED intensity module 38.

The LED switch module 40 is used by the other control modules to switch off or on the LEDs on the keypad at the set intensity level.

The present invention contemplates variations in the number and types of modules where an FPGA is used. The advantage of having various modules in the FPGA is that there is synchronized control of multiple outputs from multiple inputs. This allows multiple events to occur simultaneously. This is advantageous over using a microprocessor as control events can be received and acted upon at the same time instead of serially.

Figure 4:
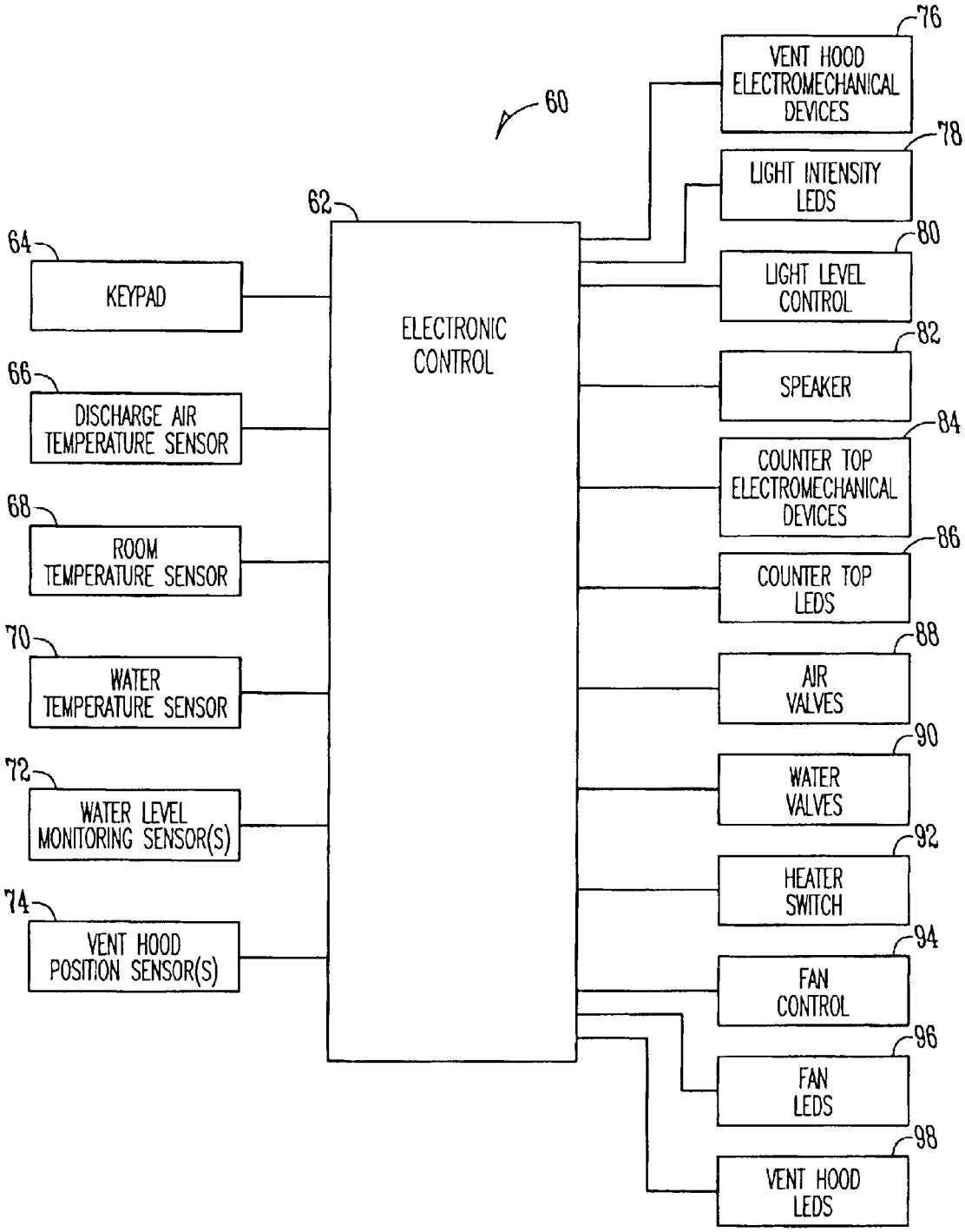
FIG. 4 is a block diagram of a control system for a kitchen island according to one embodiment of the present invention.

FIG. 4 provides a block diagram of an electronic control system 60 according to one embodiment of the present invention. The electronic control system 60 includes an electronic control 62 which may be an FPGA such as that shown in FIG. 1 or other intelligent control. A number of inputs are electrically connected to the electronic control 62. These inputs can include a keypad 64, a discharge air temperature sensor 66, a room temperature sensor 68, a water temperature sensor 70, one or more water level monitoring sensors 72, and one or more vent hood position sensors 74.

FIG. 4 also provides for a number of outputs to control aspects of the control system 60. These include vent hood electromechanical devices 76 that are electrically connected to the electronic control 62. The vent hood electromechancial devices 76 can include actuators or other electromechanical devices to vary the vertical and/or horizontal position of the vent hood 114.

Light intensity LEDs 78 are also electrically connected to the electronic control 62. The light intensity LEDs can be used to show the level of light intensity for LEDs associated with the kitchen island.

A light level control 80 is also shown electrically connected to the electronic control 62. The light level control 80 is used to control the level of the lights.

A speaker 82 or other sound producing device is also electrically connected to the electronic control 62. The speaker 82 is used to produce a tone that can be associated with presses of keys on the keypad 64 or other events, including producing an audible alert when appropriate.

Countertop electromechanical devices 84 are also electrically connected to the electronic control 62. These electromechanical devices 84 can include actuators used to move the countertop 122 and body 126 up or down or to one or more user-specified heights.

Countertop LEDs 86 are also electrically connected to the electronic control 62. The LEDs 86 are associated with the countertop 122, such as to correspond with the height of the countertop 122.

Air valves 88 are also shown to be electrically connected with the electronic control 62. The air valves 88 control air intake or other air control functions.

Water valves 90 are also electrically connected to the electronic control 62. The water valves 90 can include water fill valves and water drain valves for controlling the water level associated with a bubbler filter 132 in the kitchen island 110.

A heater switch 92 is also electrically connected to the electronic control 62. The heater switch 92 is used to turn on or off a heater 140.

A fan control 94 is electrically connected to the electronic control 62. The fan control 94 is used to change the speed of an exhaust fan 134 within the kitchen island body 126. Fan LEDs 96 are also electrically connected to the electronic control 62. The fan LEDs are used to display the level of speed of the fan 134.

Vent hood LEDs 98 are also electrically connected to the electronic control 62. The vent hood LEDs 98 can be used to show position information associated with the vent hood 114.

The present invention contemplates variations in the number, types, and function of various inputs and outputs of the kitchen island control system. Those inputs and outputs shown are merely exemplary.

Figure 5:
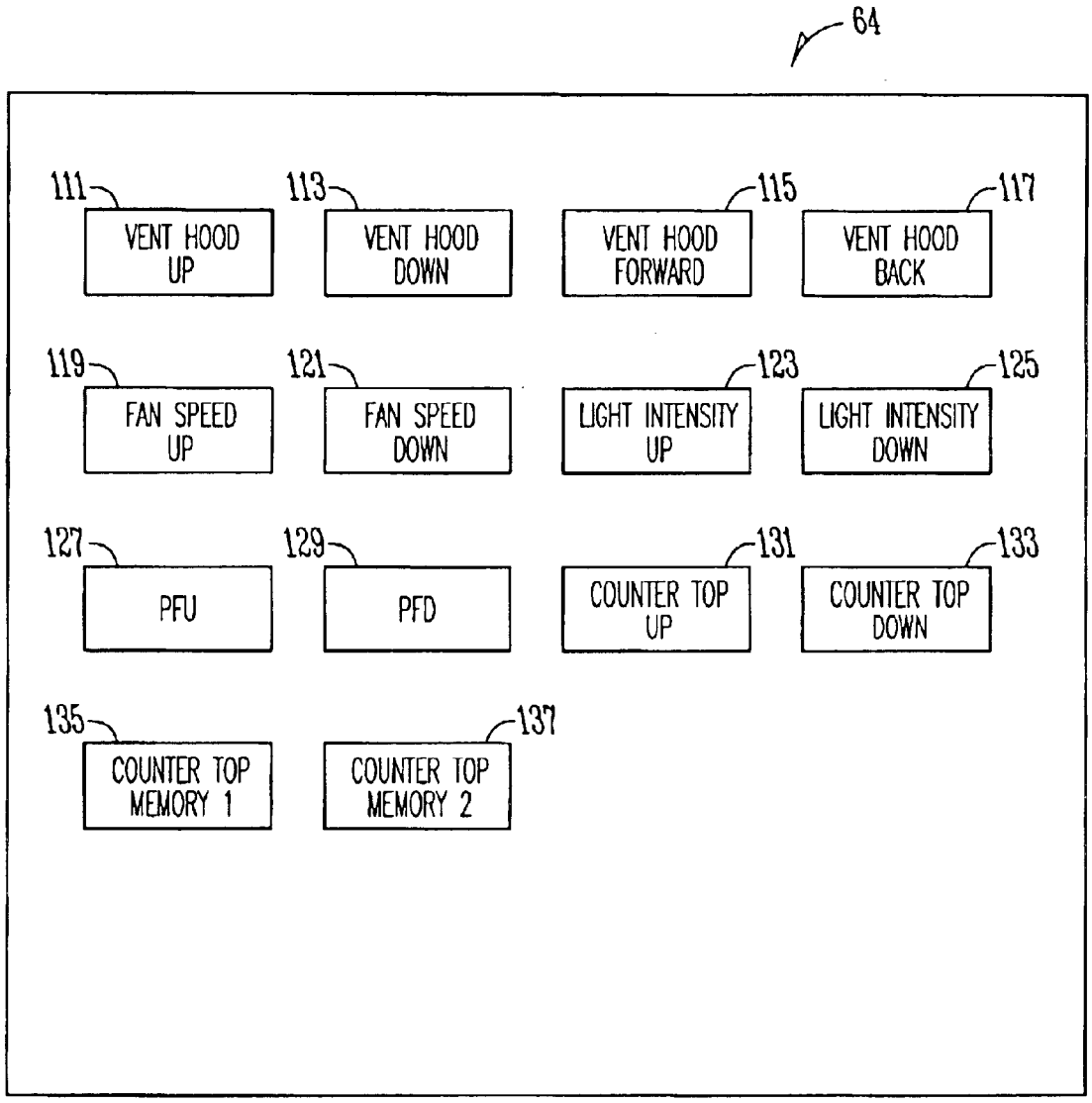
FIG. 5 is a block diagram of a keypad for a control system of a kitchen island according to one embodiment of the present invention.

FIG. 5 provides a block diagram of a keypad 64 to illustrate how the present invention provides for a number of user controls for controlling aspects of the kitchen island 110. The keypad 64 includes buttons to control movement of the vent hood 114. A vent hood 114 up button 110 raises or extends the vent hood 114. A vent hood down button 113 lowers or retracts the vent hood 114. Horizontal movement of the vent hood 114 can be imparted through vent hood forward button 115 and vent hood back button 117. The vent hood 114 is operated by a user through use of an up button 111 and a down button 113. When the vent hood 114 is initially in the "Full Down" position, a user can press the up button 111. Upon pressing the vent hood up 110 button, the vent hood 114 will rise to a level of 2 inches and stop, an alarm will continuously sound until the vent hood up button 111 or down button 113 is pressed. The hood light will turn on in the "Nightlight" intensity level.

When at the 2 inches position, if the vent hood up button 111 is pressed, the hood 114 will rise 29 inches to its "Full Up" position. As the hood 114 passes through the 12 inch position on its way to 29 inches, the horizontal extension begins and will not stop until fully extended. Also, the hood light will increase in intensity to the "Full On" level. When at the 2 inches position, if the vent hood down button 113 is pressed, the alarm will be turned off, the hood light will be turned off, and the hood 114 will lower to its "Full Down" position.

When the vent hood 114 is initially in the "Full Up" position, it operates in the following manner. If the vent hood 114 is in the full up position the horizontal position of the hood can be adjusted by pressing, and holding, either the hood forward button 115, or the hood back button 117. Movement will be sustained until the button is released, or until a fully extended or retracted position is reached. When the vent hood 114 is in the "Full Up" position and the vent hood up button is pressed, nothing will happen.

If the vent hood is initially in the "Full Up" position and the down button 113 is pressed, the vent hood will begin to lower vertically, and retract horizontally. The vent hood 114 will stop at the 12 inches height position and beep an alarm. The vent hood lights will be reduced to the "Night Light" intensity level. The vent hood 114 must be completely retracted horizontally in order to proceed, and the hood will remain stationary until either the vent hood up button 111 or down button 113 is pressed.

When the hood is at the 12 inches stationary position, if the vent hood up button 111 is then pressed, the vent hood will rise 29 inches to its "Full Up" position. The horizontal extension begins and will not stop until fully extended, also the hood light will increase in intensity to the "Full On" level.

When the hood is at the 12 inches stationary position, if the vent hood down button 113 is then pressed, the vent hood will lower to its "Full Down" position. At the 2 inches level the hood light will be switched to the "Off" position.

The fan/bubbler unit is also preferably controlled by an electronic control system and preferably by a module of an FPGA. The fan/bubbler unit has five individual speed settings, output exhaust and water temperature monitoring, exhaust temperature control, air intake control, and water level control. All fan/bubbler activities are disabled when the hood is in the "Full Down" position.

When the vent hood is not in the "Full Down" position, if the fan up button 119 is pressed, the fan will be turned on to its lowest speed setting. All subsequent fan up button 119 presses will increase fan speed until its fifth and maximum speed is reached. The inverse is also true with the pressing the fan down button 121 until the "Fan Off" position is reached.

While the fan is on, regardless of speed, an air intake valve is open. If water level is low, then water fill valve is opened allowing water to flow into the bubbler unit. When water lever rises to the preset value, fill valve will close.

In parallel with previous operations, if the water temperature exceeds 95 degrees F., then a drain valve is opened to allow water to flush out of bubbler unit. The water level indicator and the fill valve work together to stabilize the water level until the water temperature is reduced to 65 degrees F., at which point drain valve is closed.

In parallel with previous functions, if the discharge air temperature is less than the room temperature, the bubbler's heater is turned on as needed to match discharge air temperature to room temperature.

When the vent hood is in the "Full Down" position, all the functions of the fan and bubbler are disabled and "Locked Out". The air intake is closed, water fill valve is closed, the water drain valve is closed, the fan is turned off, and the bubbler's heater is disabled.

The electronic control also controls the light. The light preferably has five intensity levels, all intensity increments or decrements are sequential until a maximum or a minimum position is reached. Pressing the light up button 123 increases the intensity, while pressing the light down button 125 will decrease it. The LED's on the control panel indicate discrete levels of light intensity. The electronic control can also receive inputs from other buttons such as the PFU button 127 and the PFD button 129 for purify up and purify down functions, respectively. Alternatively, these or other buttons can be used to open and close the fill and drain valves.

The countertop control system can be described in four main portion, including "one touch" motion control, "manual" motion control, memory position setting, and memory positioning.

The "one touch" motion control enables the user to raise or lower the entire island to its maximum or minimum positions with the single touch of the countertop up button 131 or down button 133. If the island height is in any position other than the "Full Down" position, pressing the countertop down button 133 for less than one second will lower the island to its "Full Down" height of 30 inches. If the island height is in any position other than the "Full Up" position, pressing the countertop up button 131 for less than one second will raise the island to its "Full Up" height of 42 inches.

The manual motion control enables the user to raise or lower the entire island to any desired height between 30 and 42 inches. If the island height is in any position other than the "Full Down" position, pressing and holding the countertop down button 133 for greater than 1 second will continuously lower the countertop until the button 133 is released or the "Full Down" height of 30 inches is reached. If the island height is in any position other than the "Full Up" position, pressing and holding the countertop up button 131 for greater than 1 second will continuously raise the countertop until the button 131 is released or the "Full Up" height of 42 inches is reached.

The memory position settings allow the user to set specified island heights that can be recalled at the touch of a button. Two memory positions are available, that are designated as M1 and M2. After raising or lowering the island to the desired height using the manual motion control method, pressing and holding the first countertop memory button (M1) 134 or second countertop memory button (M2) 137 button for greater than five seconds will store that island height into memory for whichever button was pressed, M1 or M2. An audible beep will inform the user that the memory has been stored. The present invention contemplates that any number of memory buttons or stored positions can be saved, however, two stored positions has been found to be convenient.

Memory positioning allows the user to automatically set the island to a previously stored height. With the island in any initial position, pressing the countertop M1 135 or M2 137 button for less than 1 second will automatically adjust the island to the height stored by using the memory position setting.

The present invention further contemplates that the keypad controller 64 buttons can have LED's that will remain continuously illuminated. Also, audible tones will be generated with every keypad controller 64 button press.

Thus an electronic control system for a kitchen island has been disclosed. The present invention contemplates variations in the sensors or user inputs used as inputs into the control system, variations in the output devices, timing, selection of the electronic control features and functions, and other variations within the spirit and scope of the invention.

What is claimed is:

1. An electronic control system for an adjustable kitchen island having a cooking surface and vent hood, comprising:

an island height control for controlling a height of the adjustable kitchen island;

a vent hood control for controlling a height of the vent hood over the cooking surface;

wherein the electric control system is adapted to simultaneously control the island height control and the vent hood control.

2. The electronic control system of claim 1 wherein the electronic control system is reprogrammable.

3. The electronic control system of claim 1 further comprising an FPGA.

4. The electronic control system of claim 3 wherein the vent hood control is associated with a module of the FPGA.

5. The electronic control system of claim 1 further comprising a fan control for controlling an exhaust fan of the kitchen island.

6. The electronic control system of claim 1 further comprising a bubbler control for controlling a bubbler of the kitchen island.

7. The electronic control system of claim 1 further comprising a heater control for controlling a heater of the kitchen island.

8. The electronic control system of claim 1 further comprising a light control for controlling lights on the kitchen island.

9. The electronic control system of claim 1 further comprising a sensor for sensing the position of the vent hood.

10. An electronic control system for an adjustable kitchen island having a vent hood, comprising:

a plurality of inputs;

a plurality of outputs for controlling the adjustable kitchen island;

FPGA electrically connected to the plurality of inputs and the plurality of outputs, the FPGA having a plurality of modules associated with different sub sets of the plurality of outputs so that multiple outputs are simultaneously controllable;

wherein the plurality of FPGA modules includes a vent hood module for controlling vertical movement of the vent hood and horizontal movement of the vent hood.

11. The electronic control system of claim 10 wherein one of the FPGA modules is an island height module for controlling height of the kitchen island.

12. The electronic control system of claim 10 wherein one of the FPGA modules is a fan module.

13. The electronic control system of claim 10 wherein one of the FPGA modules is a bubbler module.

14. The electronic control system of claim 10 wherein one of the FPGA modules is a heater module.

15. The electronic control system of claim 10 wherein one of the FPGA modules is a hood light module.

16. The electronic control system of claim 10 wherein one of the FPGA modules is a tone generator module.

17. The electronic control system of claim 10 wherein one of the FPGA modules is an LED Intensity module.

18. The electronic control system of claim 10 wherein one of the FPGA modules is an LED switch module.

19. A kitchen island, comprising:

a vent hood assembly having a vent hood adapted for laterally moving between an extended position and a retracted position;

an electromechanical device operatively connected to the vent hood assembly for moving the vent hood laterally between the extended position and the retracted position;

an electronic control system electrically connected to the electromechanical device wherein the electronic control system includes an FPGA for controlling the position of the vent hood.

20. The kitchen island of claim 19 wherein the vent hood is height adjustable between raised and lowered positions.

21. The kitchen island of claim 19 wherein the FPGA controls the movement of the vent hood between the raised and lowered positions.

22. The kitchen island of claim 21 wherein the electronic control system includes sensors for sensing the positions of the vent hood.

23. The kitchen island of claim 21 wherein the FPGA is adapted to simultaneously adjust the laterally position and height of the vent hood.

24. An adjustable kitchen island having a cooking surface, a vent hood, and an electronic control system, comprising:

an island height control for controlling a height of the adjustable kitchen island;

a vent hood control for moving the vent hood laterally between the extended and the retracted position and for adjusting height of the vein hood between a raised position and a lowered position;

at least one sensor for sensing position of the vent hood;

wherein the electrical control system is adapted to simultaneously control the island height control and the vent hood control while monitoring the at least one sensor.

* * * * *